US005311253A

United States Patent [19]

Ohmori et al.

[11] Patent Number: 5,311,253

[45] Date of Patent: May 10, 1994

[54] IMAGE-FORMING APPARATUS WITH DETACHABLE IMAGING UNIT

[75] Inventors: Naoto Ohmori; Takashi Gonda, both of Osaka, Japan

[73] Assignee: Minolta Camera Kabushiki Kaisha, Osaka, Japan

[21] Appl. No.: 477,454

[22] Filed: Feb. 9, 1990

[30] Foreign Application Priority Data

Feb. 10, 1989 [JP] Japan ..... 1-31828

[51] Int. Cl.[5] ..... G03G 15/00

[52] U.S. Cl. ..... 355/200; 355/206; 355/210

[58] Field of Search ..... 355/200, 203, 205, 206, 355/210, 211, 246, 260

[56] References Cited

U.S. PATENT DOCUMENTS

| | | | |
|---|---|---|---|
| 4,243,313 | 1/1981 | Masuda et al. | 355/206 |
| 4,284,345 | 8/1981 | Sugiyama et al. | 355/299 |
| 4,500,195 | 2/1985 | Hosono | 355/208 |
| 4,634,264 | 1/1987 | Takahashi | 355/200 |
| 4,671,644 | 7/1987 | Sumida et al. | 355/319 |
| 4,791,454 | 12/1988 | Takahashi et al. | 355/299 |
| 4,796,063 | 1/1989 | Mitsuyama et al. | 355/133 |
| 4,803,521 | 2/1989 | Honda | 355/210 X |
| 4,843,437 | 6/1989 | Hamano | 355/206 |
| 4,876,572 | 10/1989 | Nagatsuna | 355/200 X |
| 4,933,718 | 6/1990 | Furuya | 355/203 |
| 4,952,974 | 8/1990 | Mori | 355/200 |

FOREIGN PATENT DOCUMENTS

| | | |
|---|---|---|
| 0298761 | 1/1989 | European Pat. Off. . |
| 60-114870 | 6/1985 | Japan . |

*Primary Examiner*—Leo P. Picard
*Assistant Examiner*—Christopher Horgan
*Attorney, Agent, or Firm*—Burns, Doane, Swecker & Mathis

[57] ABSTRACT

An image-forming apparatus includes a main body divided into a first part and a second part, an imaging unit, and a detecting device. The first part is pivotably provided to the second part to open the apparatus. The imaging unit is detachably mounted in a predetermined station of the first part. The detecting device detects whether an image forming operation can be executed or not, and is actuated only when the first part is closed to the second part with the presence of the imaging unit in the predetermined station of the first part.

12 Claims, 5 Drawing Sheets

IMAGE-FORMING APPARATUS WITH DETACHABLE IMAGING UNIT

BACKGROUND OF THE INVENTION

The present invention relates to an image-forming apparatus with a detachable imaging unit having two divided parts, an upper part and a lower part.

In an image-forming apparatus such as a copy apparatus or a printer, there has been proposed an apparatus of which the whole body is divided into two parts, an upper part and a lower part. An imaging unit including a developing device etc. is mounted on the upper part. The lower part has a passage for copy paper. Lifting of the upper part causes the passage in the lower part to open.

In such an image-forming apparatus, the opening of the passage allows a jammed copy paper to be easily removed from the apparatus. The imaging unit accommodating different color toner can be selectively used to get a desired color image.

In the apparatus, however, in removing the jammed paper therefrom, it is possible that a user contacts with a device on which a high voltage is applied. Therefore, in order to prevent the user from getting an electrical shock by contacting with the device, it is necessary that such a safety switch that the supply of electricity is cut off by the opening of the upper part is arranged at the apparatus.

In a case where sequential exchange of the imaging units with different color toner allows to the user get a multicolor image, it is possible that the user can not appreciate whether the imaging unit is mounted to the body of the apparatus now because of frequent exchange of the imaging units. Therefore, it is necessary to arrange a switch for detecting the presence of the imaging unit in the apparatus.

However, it is uneconomical to arrange the safety switch and the detecting switch separately.

SUMMARY OF THE INVENTION

Accordingly, an essential object of the present invention is to provide an image-forming apparatus with a detachable imaging unit to be capable of resolving the disadvantage.

In accomplishing these and other objects, according to one preferred embodiment of the present invention, there is provided an image-forming apparatus comprising: a main body divided into a first part and a second part, the first part being pivotably provided to the second part to open the apparatus; an imaging unit detachably mounted in a predetermined station of the first part; and detecting means for detecting whether an image forming operation can be executed or not, the detecting means being actuated only when the first part is closed to the second part with the presence of the imaging unit in the predetermined station of the first part.

By the above construction of the present invention, when the first part is closed with respect to the second part while the imaging unit is not attached to the first part, the detecting means is not actuated. Only when the first part with the presence of the imaging unit is closed, the detecting means is actuated to detect whether the image-forming operation can be executed or not.

Therefore, on the basis of a signal of the detecting means, electric power supply to each device can be controlled and the detection of the mounting of the imaging unit can be accomplished.

Therefore, it is unnecessary to separately arrange a detecting switch for controlling the electric power and a switch for detecting the mounting of the imaging unit, resulting in small space for arrangement of the detecting means and simple assembly of the apparatus.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE EMBODIMENTS

Figure 1:
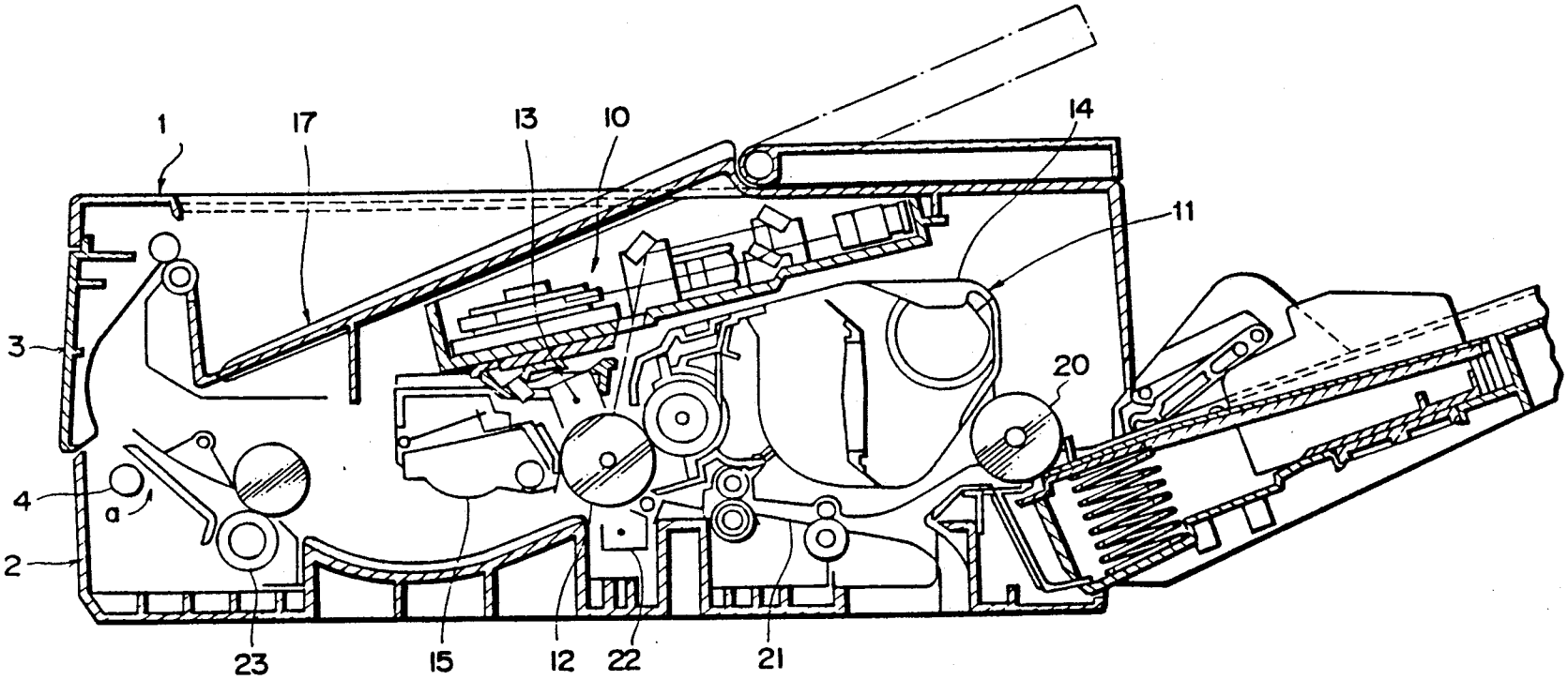
FIG. 1 is a sectional view of a laser printer of a preferred embodiment according to the present invention.

Before the description of the present invention proceeds, it is to be noted that like parts are designated by like reference numerals throughout the accompanying drawings.

Figure 2:
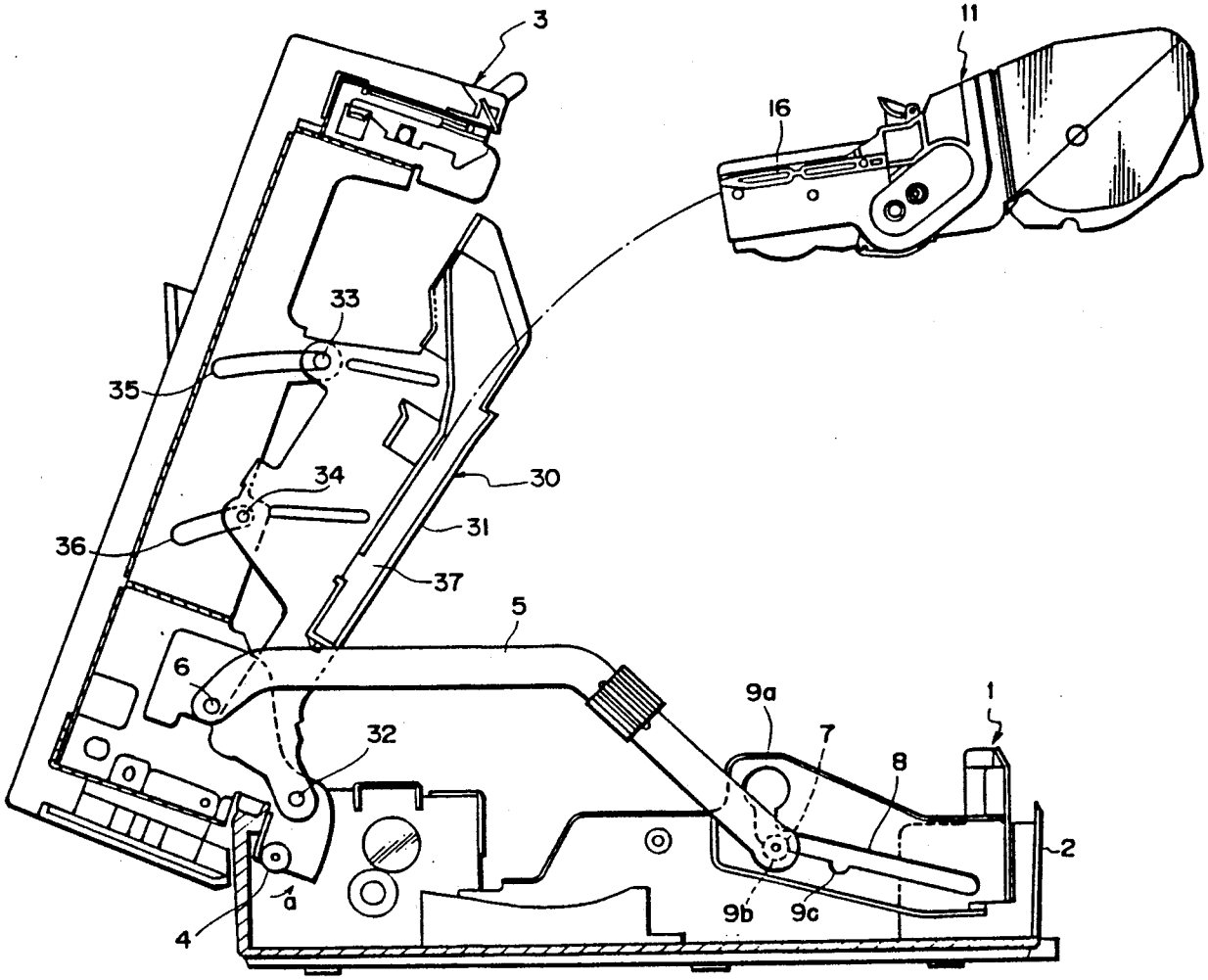
FIG. 2 is a sectional view showing a state where an upper part is opened and then an imaging unit is being removed therefrom.

FIGS. 1 and 2 show a laser printer of a preferred embodiment according to the present invention. A body 1 is divided into two parts, an upper part 3 and a lower part 2 so as to be capable of opening and closing the upper part 3 with respect to the lower part 2 around a shaft 4. The upper part 3 is urged by a spring (not shown) in a direction shown by an arrow (a). An arm 5 is rotatably arranged at the upper part 3 with a shaft 6. By engaging a pin 7 arranged at the free end of the arm 5 with one of engaging portions 9*a*, 9*b*, and 9*c* formed at a guide groove 8 of the lower part 2, the upper part 3 is held in an opening station with respect to the lower part 2.

The lower part 2 has a copy paper supply unit 20, a copy paper transporting unit 21, a transfer device 22, and a fixing device 23. The upper part 3 has an optical unit 10, an imaging unit 11, and a copy paper discharging unit 17. The imaging unit 11 is constructed by integrally combining a photosensitive drum 12, a charging device 13, a developing device 14, and a cleaning device 15 and is capable of detachably mounting to an imaging unit mounting portion 30 of the upper part 3 as shown in FIG. 2.

At the mounting portion 30, frames 31 are respectively arranged confronting with both the ends of the upper part 3 to be supported rotatably by shafts 32 arranged near the shaft 4. One of the frames 31 is not shown in FIG. 2. Each frame 31 has pins 33 and 34. The pins 33 and 34 are inserted into guide grooves 35 and 36 formed in circular arc around the shaft 32 at the upper part 3 so as to regulate the opening angle of the frames 31. Guides 37 are respectively provided at portions where the frames 31 confront with each other.

The imaging unit 11 is mounted to the frames 31 in a predetermined station in such a manner that projections 16 arranged at both the sides of the imaging unit 11 are engaged with the guides 37, as shown in FIG. 2.

Figure 3:
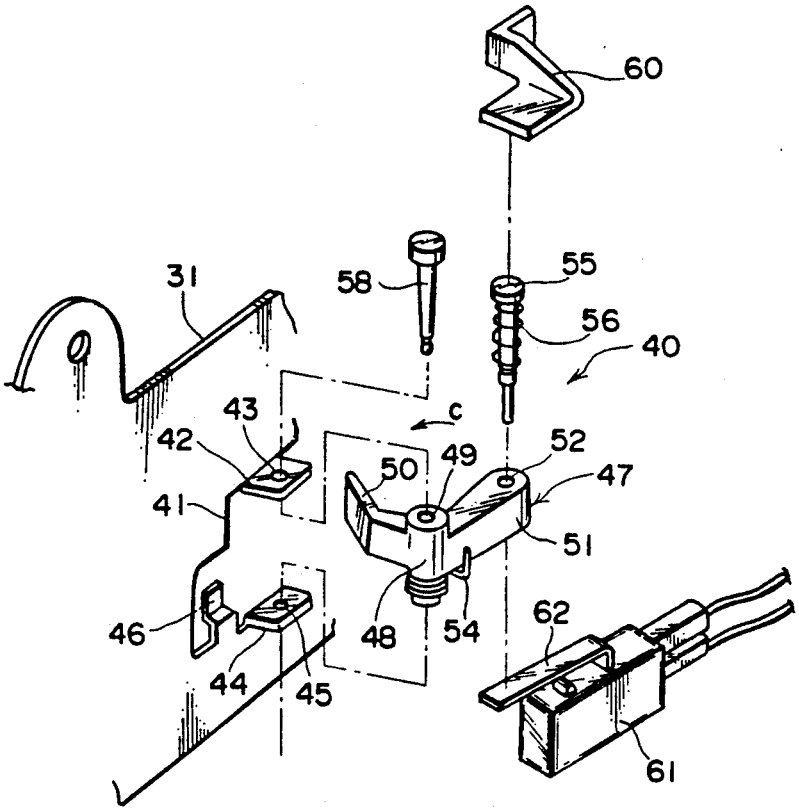
FIG. 3 is an exploded perspective view showing a first embodiment of a detecting device thereof.
Figure 5:
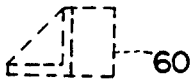
FIG. 5 is a side view showing a state where a microswitch is tuned on in the device.
Figure 4:
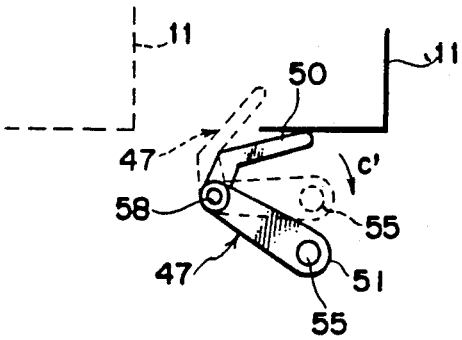
FIG. 4 is a plan view showing the movement of an actuator of the device.
Figure 4:
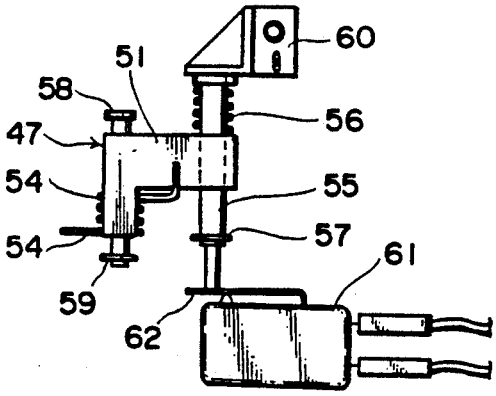

A detecting device 40 shown in FIGS. 3–5 serves to detect the opening state of the upper part 3 and the mounting state of the imaging unit 11.

In the device 40, an opening 41 is formed at one of the frames 31 of the mounting portion 30 and attaching portions 42 and 44 are formed at the upper and lower edges of the opening 41 by bending parts of the frame 31 at right angles. A stopper 46 is formed at the one edge of the opening 41 and adjacent to the attaching portion 45 by machining.

An actuator 47 has a cylindrical body 48 and two arms 50 and 51 at the side of the body 48. The arm 51 has a hole 52 parallel to a through hole 49 of the body 48. A pin 55 is inserted into the hole 52. A coil spring 56 is attached to the upper of the projection of the pin 55 and after insert of the hole 52, a stopper 57 is attached to the lower of the projection thereof so as to hold the pin 55 in a lifting state by the urging force of the spring 56 while the stopper 57 prevents the pin 55 from removing from the hole 52.

The actuator 47 is arranged at the opening 41 in a manner that the arm 50 is located inside the frame 31 and the arm 51 is located outside the frame 31. A pin 58 is inserted into holes 43 and 44 of the attaching portions 42 and 44 and the through hole 49 of the body 48 so that the actuator 47 is rotatably supported by the frame 31. The actuator 47 has a coil spring 54 around the lower of the body 48. The ends of the spring 54 are respectively engaged with the arm 51 and the frame 31 to urge the actuator 47 in a direction shown by an arrow (c) by the urging force of the spring 54 and thus the arm 50 is located to contact with the stopper 46 under pressure. A stopper 59 is attached to the distal end of the pin 58 to prevent the pin 58 from removing from the holes 43, 44, and 49.

On the other hand, the upper part 3 has a press member 60 and the lower part 2 has a microswitch 61.

In the detecting device 40 with the above-described construction, as shown in FIG. 2, when the upper part 3 is opened with respect to the lower part 2 and the imaging unit 11 is not mounted to the frames 31, the actuator 47 is in a state shown by a dotted line in FIG. 4.

When the imaging unit 11 is mounted to the frames 31 in the predetermined station, the arm 50 protruding inside the frame 31 is pressed by the imaging unit 11 as shown by a solid line in FIG. 4, resulting in rotation of the actuator 47 in the direction shown by an arrow (c').

Next, when the upper part 3 begins to be closed with respect to the lower part 2, the imaging unit 11 firstly comes in contact with the lower part 2.

When the upper part 3 is further closed, the frames 31 relatively move close to the upper part 3. As shown in FIG. 5, the press member 60 of the upper part 3 presses the upper of the pin 55 to downward move the pin 55 in correspondence with the downward movement of the upper part 3. The upper part 3 is locked to the lower part 2 and simultaneously the pin 55 presses a detecting lever 62 of the microswitch 61 downward.

As a result, the microswitch 61 is operated to be capable of supplying an electric power to each device and operating the laser printer for execution of an image forming operation.

When the upper part 3 is closed while the imaging unit 11 is not mounted to the upper part 3, the actuator 47 is held in the state shown by the dotted line in FIG. 4. Therefore, the pin 55 is located to a position shown by the dotted line in FIG. 4 and then the pin 55 does not come in contact with the press member 60 even though the upper part 3 is closed. Thus, the microswitch 61 is not operated.

Figure 6:
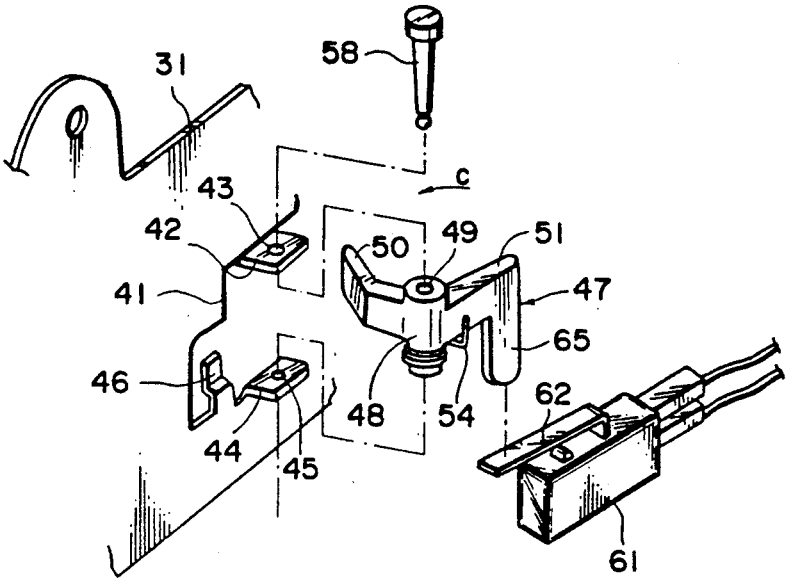
FIG. 6 is an exploded perspective view showing a second embodiment of the detecting device.
Figure 7:
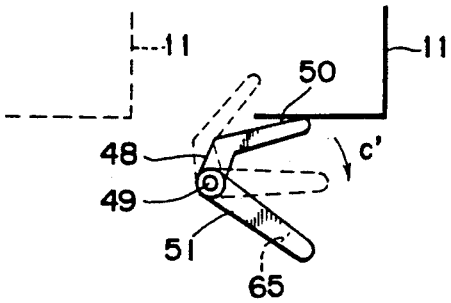
FIG. 7 is a plan view showing the movement of an actuator of the device.
Figure 8:
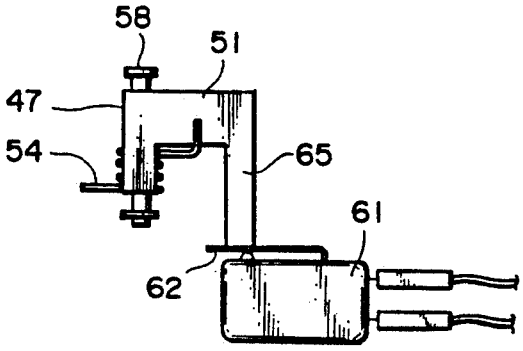
FIG. 8 is a side view showing a state where a microswitch is tuned on in the device.

FIGS. 6–8 show a second embodiment of the detecting device 40. In the second embodiment, an actuating portion 65 is arranged at the underside of the distal end of the arm 51 of the actuator 47.

When the imaging unit 11 is mounted to the frames 31 while the upper part 3 is opened, the actuator 47 in this detecting device 40 rotates in the direction shown by an arrow (c') in FIG. 7.

Next, when the upper part 3 begins to be closed, the imaging unit 11 comes in contact with the lower part 2 and simultaneously the actuating portion 65 presses the detecting lever 62 of the microswitch 61 to operate the microswitch 61.

When the upper part 3 is further closed, the lower part 2 is locked to the upper part 3.

Figure 9:
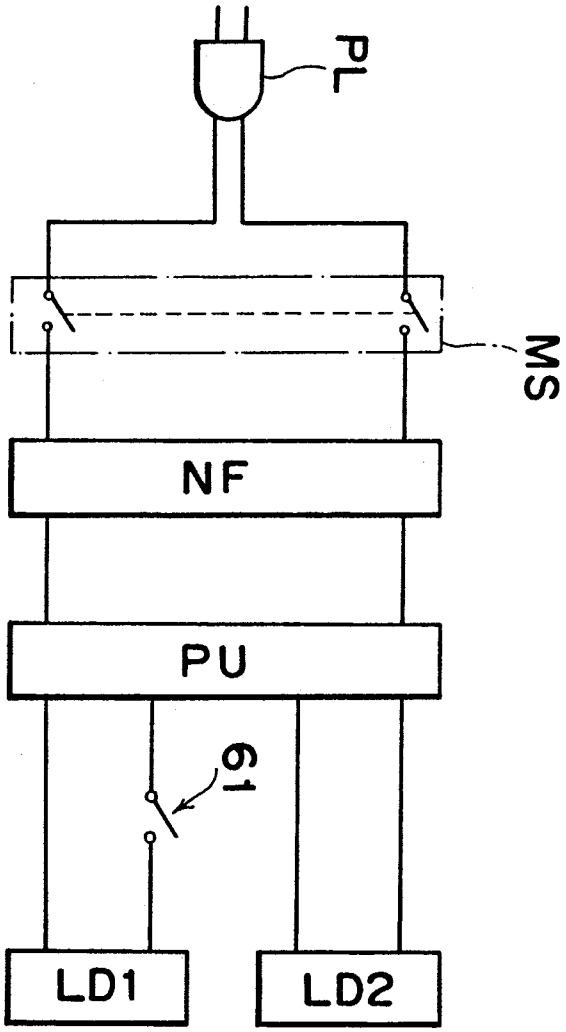
FIG. 9 is a block diagram showing connection between an appliance plug and loads through a power supply unit.

On the other hand, when the upper part 3 is closed without mounting the imaging unit 11, the actuator 47 is located to a position shown by a dotted line in FIG. 7. Therefore, the actuating portion 65 downward moves at the side of the microswitch 61 without press of the lever 62. Thus, the microswitch 61 is not operated. In the state of turning-on of the microswitch 61, the microswitch 61, as shown in FIG. 9, causes a power supply unit PU to electrically connect to a load LD1 such as the optical unit 10 and the imaging unit 11 to supply an electric power to elements in the laser printer. In FIG. 9, PL denotes an appliance plug, MS a main switch of the laser printer, and NF a filter for removing unwanted noise entered from an external source. The unit PU converts alternating current voltage applied by the external source into direct current voltages of 5 and 24 volts. The direct current voltage of 5 V is used for operations such as a back-up operation of volatile memories to be supplied to a load LD2 regardless of the state of the microswitch 61.

Though the microswitch 61 is arranged at the lower part 2 in the above description, the microswitch 61 can be arranged at the upper part 3. In this case, the pin 55 is arranged at the actuator 47 while the pin 55 is urged downward, and when the imaging unit 11 comes in contact with the upper part 2, the pin 55 moves upward to operate the microswitch 61. Similarly, the actuating portion 65 is preferably attached directing upward in the second embodiment.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image-forming apparatus comprising:

a main body divided into a first part and a second part, the first part being pivotably provided to the second part to open the apparatus;

an imaging unit detachably mounted in a predetermined station of the first part;

actuator means provided to the first part and movable between a first position with the presence of said imaging unit in the predetermined station and a second position with the absence of said imaging unit in the predetermined station; and switch means provided to the second part and actuated with said actuator means positioned at the first position, wherein said switch means is actuated by said actuator means only when the first part is closed to the second part with the presence of said imaging unit in the predetermined station of the first part.

2. An image-forming apparatus as claimed in claim 1, wherein said switch means causes elements of the apparatus to electrically connect to an electric power source at an ON state.

3. An image-forming apparatus with a detachable imaging unit, comprising:

a main body divided into a first part and a second part, the first part being pivotably provided to the second part to open the apparatus;

a unit receiving portion to which the imaging unit is detachably mounted, said unit receiving portion being pivotably provided to the first part;

actuator means provided to said unit receiving portion, said actuator means being movable between a first position with the presence of the imaging unit in said unit receiving portion and a second position with the absence of the imaging unit in said unit receiving portion, said actuator means positioned at the first position being further movable toward the second part;

pressing means provided to the first part for pressing down said actuator means positioned at the first position toward the second part; and switch means provided to the second part, said switch means being actuated by said actuator means which is positioned at the first position and pressed down by said pressing means when the first part is closed to the second part with the presence of the imaging unit in said unit receiving portion.

4. An image-forming apparatus as claimed in claim 3, wherein said switch means causes elements of the apparatus to electrically connect to an electric power source at an ON state.

5. An image forming apparatus comprising:

a main body divided into two parts which are pivotably connected to each other to open the apparatus;

an imaging unit detachably mounted in a predetermined station of one of the two parts; and detecting means for detecting whether an image forming operation can be executed or not, the detecting means being actuated only when the two parts are closed and when the imaging unit is mounted in the predetermined station.

6. An image forming apparatus as claimed in claim 5, wherein the detecting means includes a safety switch which allows the image forming operation at an ON state thereof.

7. An image forming apparatus comprising:

a main body divided into a first part and a second part, the first and second parts being pivotably connected to each other to open the apparatus:

an imaging unit detachably mounted in a predetermined station of the first part;

actuator means provided to the first part and movable between a first position indicating presence of the imaging unit in the predetermined station and a second position indicating absence of the imaging unit in the predetermined position; and switch means provided to the second part and actuated with the actuator means positioned at the first position, wherein the switch means is actuated by the actuator means only when the first and second parts are closed.

8. An image forming apparatus as claimed in claim 7, wherein the switch means includes a safety switch which allows the image forming operation at an ON state thereof.

9. An image forming apparatus as claimed in claim 7, wherein the actuator means pivotably moves between the first and second positions according to movement of the imaging unit.

10. An image forming apparatus with a detachable imaging unit, comprising:

a main body divided into a first part and a second part, the first and second parts being pivotably connected to each other to open the apparatus;

a unit receiving portion to which the imaging unit is detachably mounted, the unit receiving portion being pivotably provided to the first part;

actuator means provided to the unit receiving portion and movable between a first position indicating presence of the imaging unit in the unit receiving portion and a second position indicating absence of the imaging unit in the unit receiving portion, the actuator means positioned at the first position being movable toward the second part;

pressing means provided to the first part for pressing the actuator means positioned at the first position toward the second part; and switch means provided to the second part, the switch means being actuated with the actuator means positioned at the first position and pressed by the pressing means when the first and second parts are closed.

11. An image forming apparatus as claimed in claim 10, wherein the switch means includes a safety switch which allows the image forming operation at an ON state thereof.

12. An image forming apparatus as claimed in claim 10, wherein the actuator means pivotably moves between the first and second positions according to movement of the imaging unit.

* * * * *